US005181861A

United States Patent [19]

Gaver, Jr. et al.

[11] Patent Number: 5,181,861

[45] Date of Patent: * Jan. 26, 1993

[54] MANUALLY INSTALLABLE COAXIAL CABLE CONNECTOR

[75] Inventors: Joseph C. Gaver, Jr., Horseheads; James C. Jorgenson, Montour Falls, both of N.Y.

[73] Assignee: LRC Electronics, Inc., Horseheads, N.Y.

[ * ] Notice: The portion of the term of this patent subsequent to Nov. 19, 2008 has been disclaimed.

[21] Appl. No.: 755,153

[22] Filed: Sep. 5, 1991

Related U.S. Application Data

[63] Continuation-in-part of Ser. No. 657,508, Feb. 19, 1991, Pat. No. 5,066,248.

[51] Int. Cl.[5] ..... H01R 13/00

[52] U.S. Cl. ..... 439/578

[58] Field of Search ..... 439/394, 578–585

[56] References Cited

U.S. PATENT DOCUMENTS 3,744,007 7/1973 Horak ..... 439/394

4,739,126 4/1988 Gutter et al. ..... 439/394

FOREIGN PATENT DOCUMENTS 1109914 4/1984 United Kingdom ..... 439/394

*Primary Examiner*—Joseph H. McGlynn

*Attorney, Agent, or Firm*—Weingarten, Schurgin, Gagnebin & Hayes

[57] ABSTRACT

A manually installable coaxial cable connector comprises a housing sleeve, a connector body, a locking ring, and a center post which co-act to permit installation of the connector on both coaxial cable and an interface port, without the use of any installation tool. Cable outer jacket retention is ensured for a wide range of braided shield percentage cables by a plurality of serrations on fingers of the connector body. A stepped feature of an annular collar on the connector body ensures metal-to-metal contact and good retention between the connector body collar and an interface port. Installation of the connector onto a properly prepared piece of coaxial cable is achieved by simply pushing the connector onto the cable, removing a protective cap and manually sliding the housing sleeve until the locking ring locks into place. The connector is slipped onto an interface port whereupon the housing sleeve is manually pushed forward to lock the connector onto the interface port. The connector is removed from the interface port by simply pulling the housing sleeve backward and slipping the connector off of the interface port.

19 Claims, 5 Drawing Sheets

MANUALLY INSTALLABLE COAXIAL CABLE CONNECTOR

RELATED APPLICATIONS

This application is a continuation-in-part of U.S. Pat. No. 07/657,508, filed Feb. 19, 1991, now U.S. Pat. No. 5,066,248.

FIELD OF THE INVENTION

The present invention relates to connectors for coaxial cables, and more particularly to a connector which is manually installable on coaxial cable and on a mating connector interface port.

BACKGROUND OF THE INVENTION

Coaxial connectors, such as F-type coaxial cable connectors are typically threaded onto a complementary interface port to electrically integrate coaxial cables to various electronic devices such as TVs, VCRs, cable converters and various radio systems.

Prior art coaxial cable connectors present several limitations involving the mating and assembly of the connector with a coaxial cable, and the interfacing of the connector with a mounting or interference port of an electronic device. In particular, the process of integrating prior art coaxial cable connectors with coaxial cable tends to be a tedious process. The installer has to ensure that the braided shield of the coaxial cable is properly engaged with the metallic elements of the connector board. Prior art cable connectors generally require special crimp tooling to secure the cable in mated combination with the connector body. Such crimp tooling is often not adaptable for use with different sizes of connector bodies. Also, the configuration of many connector bodies limits their use to coaxial cables having braided shield percentages in a narrow range.

Moreover, increased utilization of home video and cable entertainment equipment results in frequent and repetitive connect/disconnect cycles. Typical prior art connectors require cumbersome threading of the coaxial cable connector onto the interface port of electronic equipment. Such a threading operation tends to be awkward and relatively time consuming. Further, to ensure RF shielding the threaded connection needs to be tightened to a minimum of two-inch pounds, which is not normally achievable without a tool.

SUMMARY OF THE INVENTION

According to the present invention, a manually installable coaxial cable connector includes a housing sleeve, a connector body, a center post, and a locking ring which co-act to permit installation of the connector on both coaxial cable and an interface port, manually, without the use of any installation tool. Good metal-to-metal contact between the braided shield of the coaxial cable and the connector is ensured for a wide range of braided shield percentage cables by the center post being frictionally engaged into the connector body and sandwiched under the braid. A plurality of serrations on fingers assures good cable to connector retention by application of a continuous motion to the connector housing sleeve until an integral positive stop is achieved. A stepped feature of an annular collar on the connector body ensures good metal-to-metal contact and good retention between the connector body collar and an interface port.

Features of the invention include installation of the connector onto a properly prepared piece of coaxial cable by simply pushing the connector onto the cable, removing a protective cap and manually sliding the housing sleeve in a first direction until the locking ring locks into place. The connector is slipped onto an interface port whereupon the housing sleeve is manually pushed forward in the opposite direction to lock the connector onto the interface port. No cumbersome threading is required. The connector is removed from the interface port by simply pulling the housing sleeve backward and slipping the connector off of the interface port.

Further features of the invention include a nickel/silver alloy collar to ensure long life under repeated connect/disconnect cycles and excellent corrosion resistance in damp environments. The housing sleeve is made durable and UV resistant. RF shielding is achieved without tools for crimping or tightening threaded connections. The collar has points on a plurality of locking tabs or locking ring travel stops to help prevent the locking ring from working loose during installation. The center post has an interior flange to help prevent dielectric material in cable from pushing beyond an interface end during installation. The center post additionally can be formed with a radial depression to co-act with a crimped collar to greatly increase the force required to displace the center post from the collar.

DESCRIPTION OF THE DRAWING

These and other features and advantages of the present invention will become more apparent in light of the following detailed description of an illustrative embodiment thereof, as illustrated in the accompanying drawings, of which.

DETAILED DESCRIPTION OF THE INVENTION

Figure 1:
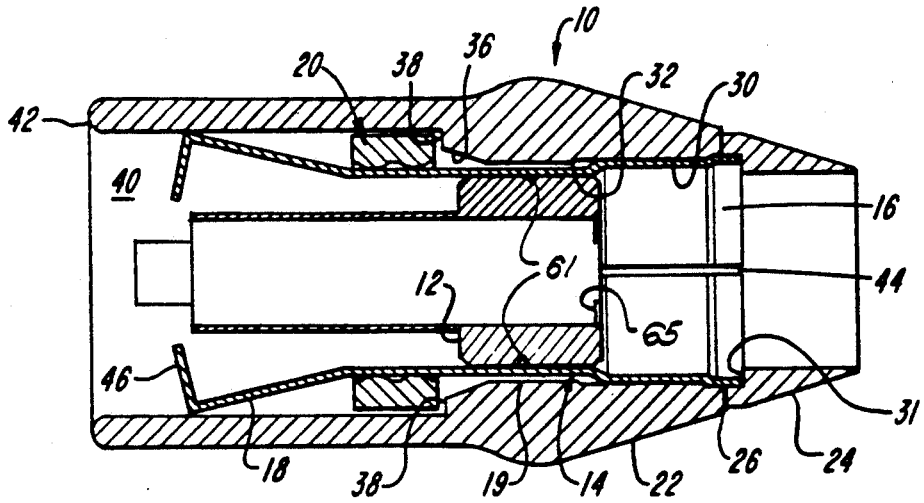
FIG. 1 is a side sectioned view of a manually installable coaxial cable connector according to the invention.

A manually installable coaxial cable connector 10, as illustrated in FIG. 1, comprises a center post 12 which is friction fit into a connector body 14. The connector body 14 comprises a slotted collar end 16 and a resilient fingered end 18 and has an intermediate portion 19 disposed therebetween. A locking ring 20 is disposed about the connector body 14 intermediate portion 19 proximate to the resilient fingered end 18. An assembled connector comprises the center post 12, connector body 14 and locking ring 20 slip fitted into a housing sleeve 22. An end cap 24 is disposed at an interface end 26 of the housing sleeve 22 to retain the connector innards before the connector is used.

Figure 2:
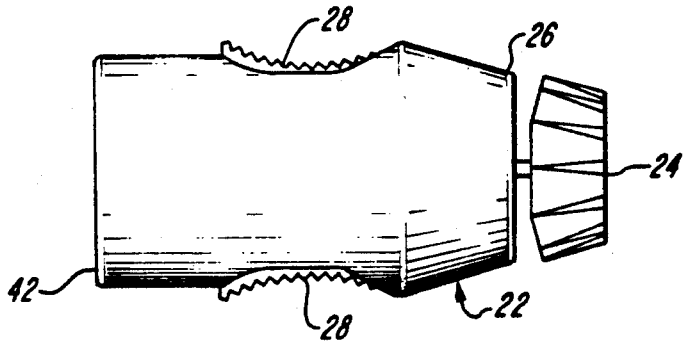
FIG. 2 is a plan view of a housing sleeve of the manually installable coaxial cable connector of FIG. 1.

The housing sleeve 22, referring now to FIGS. 1 and 2, is a molded insulative plastic piece, which is preferably fabricated of a durable UV resistant plastic, such as Celcon UV90 (which is a trademark of Hoechst Celanese Corporation). An exterior surface of the housing sleeve 22 has a plurality of knurled or jagged portions 28 to facilitate manual gripping of the housing sleeve 22 for actuation and installation of the connector 10 as discussed hereinafter.

Interior surfaces of the housing sleeve 22 are contoured to co-act with various elements of the manually installable coaxial cable connector 10. The interior surface proximate to the interface end 26 of the housing sleeve 22 is cylindrical in a first stage 30 and tapered in a second stage 32. Stage 32 narrows progressively away from an inclined surface 36. The inclined surface 36 proximate the second stage 32 of the tapered interior surface terminates at a housing interior shoulder 38. The remainder of the interior of housing sleeve 22 comprises a substantially cylindrical void 40 which is open at a cable insert end 42.

Figure 3:
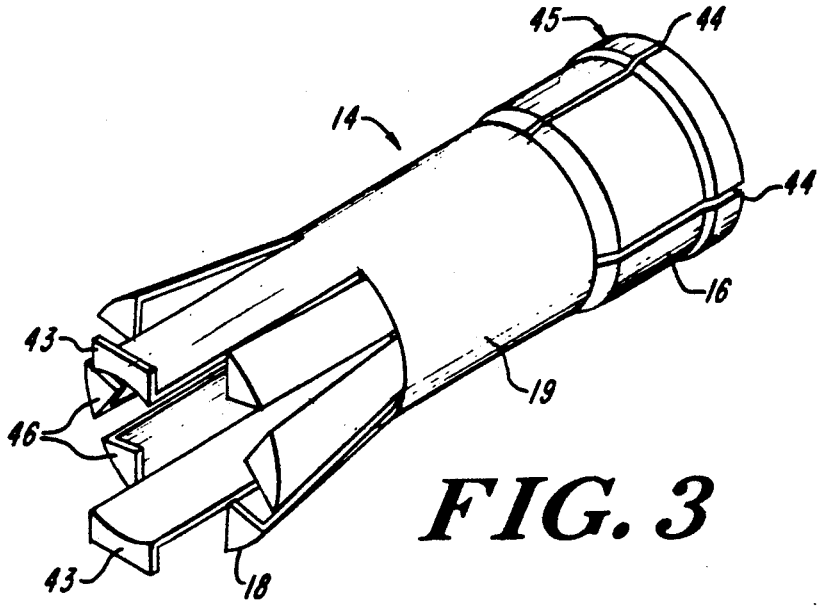
FIG. 3 is a perspective view of a connector body and collar of the manually installable coaxial cable connector of FIG. 1.

Referring now to FIG. 3, connector body 14, comprising slotted collar end 16 and fingered end 18, is dimensioned for installation in the housing sleeve 22 by press fit engagement between the collar end 16 of the connector body 14 and stage 32 of the interior of housing sleeve 22. Collar end 16 has a plurality of slots 44 which permit compression of the collar end 16 of the connector body 14 for frictional engagement of an outer sheath 63 of a coaxial cable interface (FIG. 6B) upon installation as discussed hereinafter.

Figure 6A:
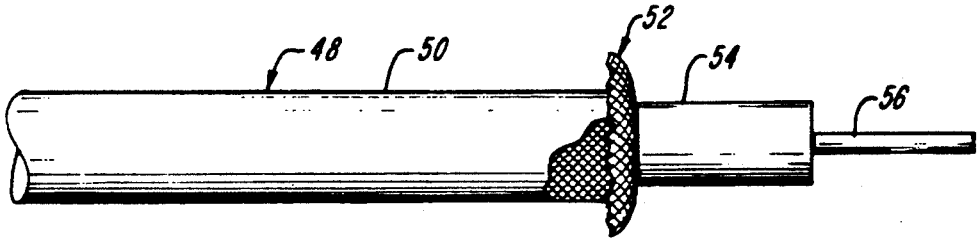
FIG. 6A illustrates a coaxial cable prepared for integration with the connector of FIG. 1.
Figure 9:
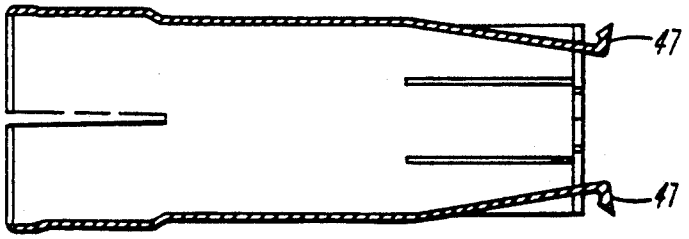
FIG. 9 is a side sectioned view of a connector body and collar having points on locking tabs.

The resilient fingered end 18 of the connector body 14 comprises a plurality of flared axial serrations 46 which retain the locking ring 20 (see FIG. 1) and can "bite" into a wide range of braided shield percentages of coaxial cable. Upon installation of a prepared coaxial cable 48, (FIG. 6A) into an assembled manually installable coaxial cable connector 10, the serrations 46 pierce the cable jacket or insulation 50 and make mechanical contact with the outer jacket 50. However, the serrations 46 are fabricated of such dimension so as to preclude fully piercing coaxial cable interior insulation 54 to avoid mechanically and electrically contacting a center conductor 56 of the coaxial cable 48 with any portion of the conductive connector body 14. A plurality of locking tabs in the form of 90° outward bends formed on opposed non-serrated fingers, can be provided with points 47 as illustrated in FIG. 9

A substantially cylindrical intermediate portion 19 of the connector body 14 resides between the collar end 16 and the resilient fingered end 18 thereof. Preferably, the entire connector body 14, including collar end 16, fingered end 18 and cylindrical intermediate portion 19, is fabricated from a conductive metal or alloy which possesses good corrosion resistance characteristics in damp environments and which will withstand repeated connect/disconnect cycles. A nickel/silver alloy provides such desirable characteristics.

Figure 4:
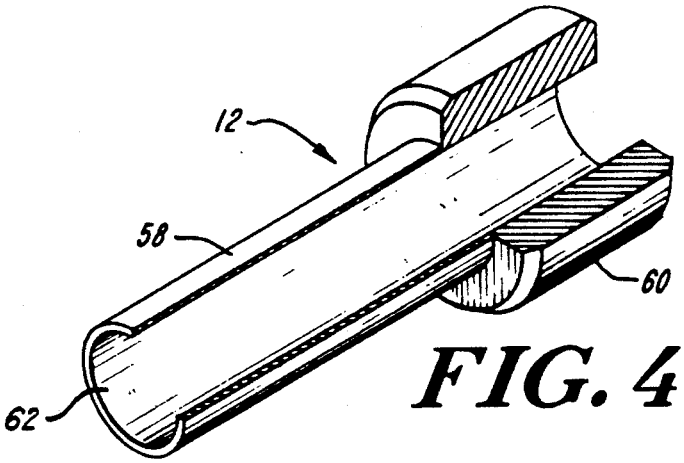
FIG. 4 is a perspective view partially in section of a center post of the manually installable coaxial cable connector of FIG. 1.
Figure 10:
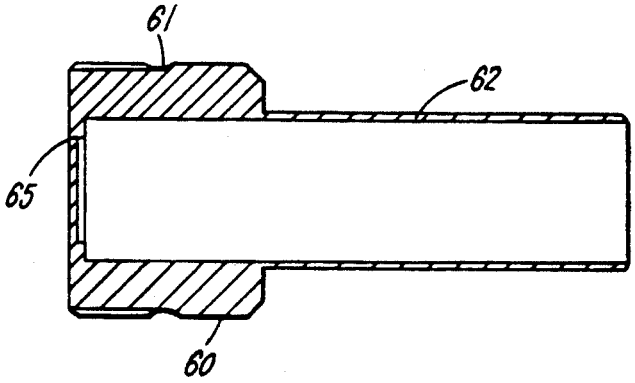
FIG. 10 is a side sectioned view of a center post having a radial depression and flange.
Figure 10A:
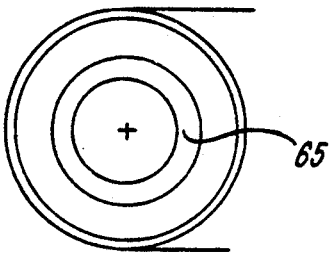
FIG. 10A is a front end on view of the center post of FIG. 10.

The center post 12 of the manually installable coaxial cable connector 10, as illustrated in FIG. 4, has a tubular portion 58 integral with a wide annular portion 60, both of which have a bore 62 extending substantially therethrough. The wide annular portion 60 has an outer diameter dimensioned to conform to and permit frictional engagement of the center post 1 within the intermediate portion 19 of the connector body 14, as illustrated in FIGS. 1 and 7A/B. The wide annular portion 60 can be provided with a radial depression 61 circumscribing its exterior as illustrated in FIGS. 10 and 10A. The radial depression is dimensioned to coact with the intermediate portion 19 which can be crimped proximate to the radial depression when the center post is installed within the collar body as discussed hereinafter. Such a crimp greatly increases the force required to displace the center post from the collar. The center post 12 further can be provided with a flange 65 on its interior. The flange 65 provides a stop to limit travel of cable installed within the connector. The flange 65 engages the interior insulation 54 of the cable to help prevent the insulation 54 from being pushed too far out of the collar end of the connector body 14.

Figure 6B:
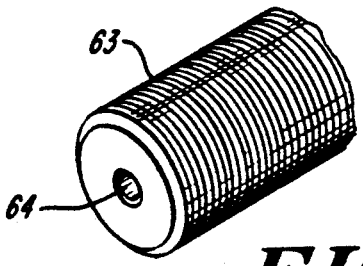
FIG. 6B is a perspective view of a coaxial cable interface port.

The tubular portion 58 of the center post 12 has a thin wall which electrically engages the braided shield 52 of the prepared coaxial cable and which accommodates the interior insulation 54 of the cable to align the center conductor 56 for insertion into a complementary conductive receptacle 64 of the interface port (FIG. 6B). The center post 12 is preferably fabricated from a suitable conductive material such as tin plated brass.

Figure 5:
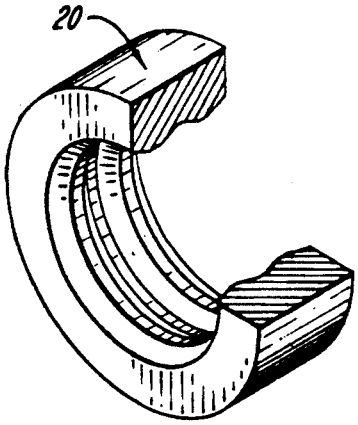
FIG. 5 is a perspective view partially in section of a locking ring of the manually installable coaxial cable connector of FIG. 1.

Referring to FIGS. 1, 5 and 7A/B, the manually installable coaxial cable connector 10 according to the invention has a locking ring 20 disposed about the connector body 14 proximate to the resilient fingered end 18 thereof. The locking ring 20 is an annular piece which is preferably constructed of plastic material having heat resistance and durability characteristics similar to those of the housing sleeve 22. A material such as Celcon UV90 is suitable for both the locking ring 20 and the housing sleeve 22 discussed hereinbefore. The locking ring 20 has an inner diameter defining a void which slidably accommodates the intermediate portion 19 of the connector body 14.

The manually installable coaxial cable connector 10 is assembled by slipping the locking ring 20 over the fingered end 18 of the connector body 14. The 90° outward bend 43 is formed, prior to assembly, on at least two opposed non-serrated fingers on the fingered end 18 to act as a stop to limit travel of the locking ring 20. At that point, the resilient fingers are flared outwardly. The center post 12 is then slip fit into the connector body 14 and the intermediate portion of the connector body is crimped substantially into radial depression 61 of the center post 12. The assembly comprising locking ring 20, center post 12 and connector body 14 is then inserted into the housing sleeve 22 through the cable insert end 42 and pressed through the tapered interior of the housing sleeve until the collar end 16 of the connector body 12 engages a shoulder 31 of the installed end cap 24.

For proper use of the manually installable coaxial cable connector, the prepared coaxial cable 48 (see FIG. 6A) has the outer jacket 50 removed and the braided shield 52 drawn back to expose the interior insulation 54. The interior insulation 54 is stripped to expose a portion of the center conductor 56 sufficient to make adequate electrical contact with the complementary conductive receptacle 64 of the coaxial cable interface port (FIG. 6B).

The prepared coaxial cable 48 is inserted into the cable insert end 42 of the manually installable coaxial cable connector 10, as illustrated in FIG. 7A, with a continuous motion until the thin walled tubular portion 58 of the center post 12 mechanically and electrically engages the braided shield 52 of the cable and/or until the interior insulation 54 abuts the flange 65 of the center post 12. Preferably the coaxial cable is prepared and engaged on the center post 12 so that the folded back braided shield abuts the wide annular portion 60 and the exposed interior insulation 54 is fully engaged within the part of the bore 62 having the wide annular portion 60 disposed thereabout.

When the cable is inserted in the assembled manually installable coaxial cable connector according to the invention, as illustrated in FIG. 7A, the locking ring 20 disposed about the intermediate portion 19 of the connector body 14 may abut the shoulder 38 of the housing sleeve 22. The serrations 46 are flared and may rest against the cable jacket 50. The manually installable coaxial cable connector 10 is secured or locked onto the inserted coaxial cable by removing the end cap 24 and manually actuating the housing sleeve 22 in a first direction 66 toward the cable insert end 42. In doing so, the housing sleeve 22 shoulder 38 drives the locking ring in the first direction 66 so that the locking ring 22 compresses the flared fingered end 18 of the connector body 14. Compression of the flared fingered end 18 causes the axial serrations 46 to penetrate the outer jacket 50 of the coaxial cable 48 to make mechanical contact with the outer jacket 50. Actuation of the locking ring 20 in the first 12 direction 66 will be limited by the stop formed by bends 43 integral with the connector body 14. The points 47 on the bends or locking ring travel stops 43 provide a high degree of frictional engagement with the end and interior of the locking ring 20 to help prevent the locking ring 20 from being actuated beyond the stop limit during installation.

Figure 7B:
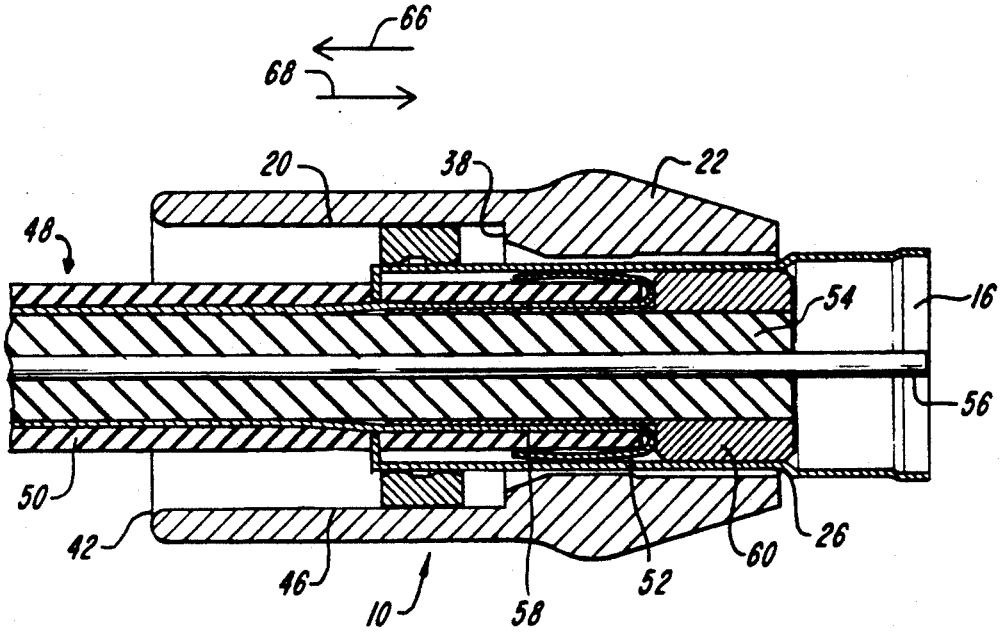
FIG. 7B is a side section view of the connector of FIG. 1 having prepared cable installed therein, the end cap removed, the locking ring engaged and prepared for attachment to a coaxial cable interface port.
Figure 7A:
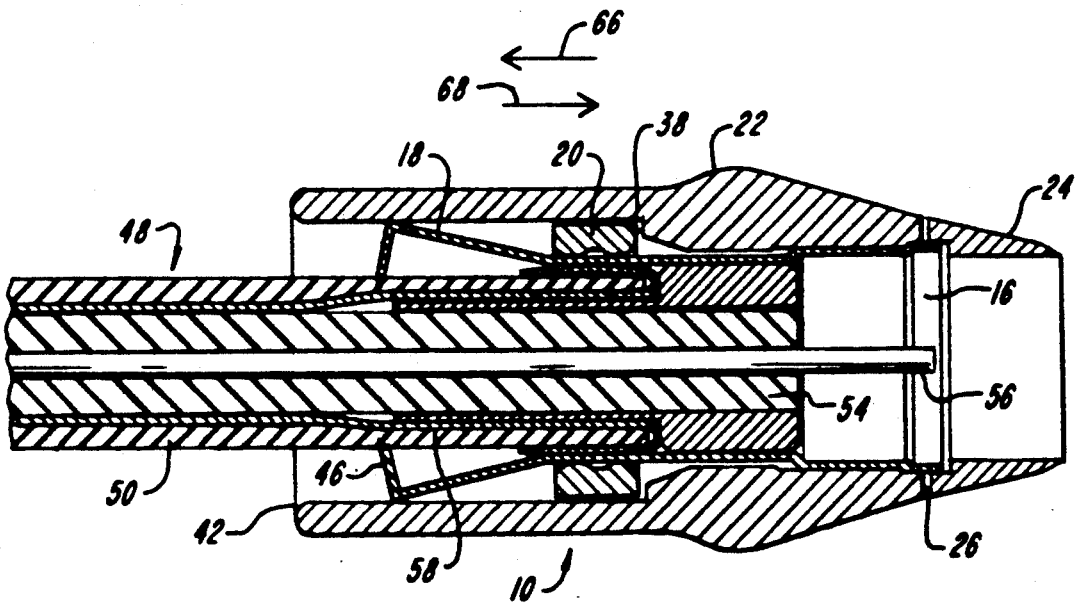
FIG. 7A is a side section view of the connector of FIG. 1 having prepared cable installed therein, prior to the locking ring being engaged and prior to the end cap being removed.
Figure 8:
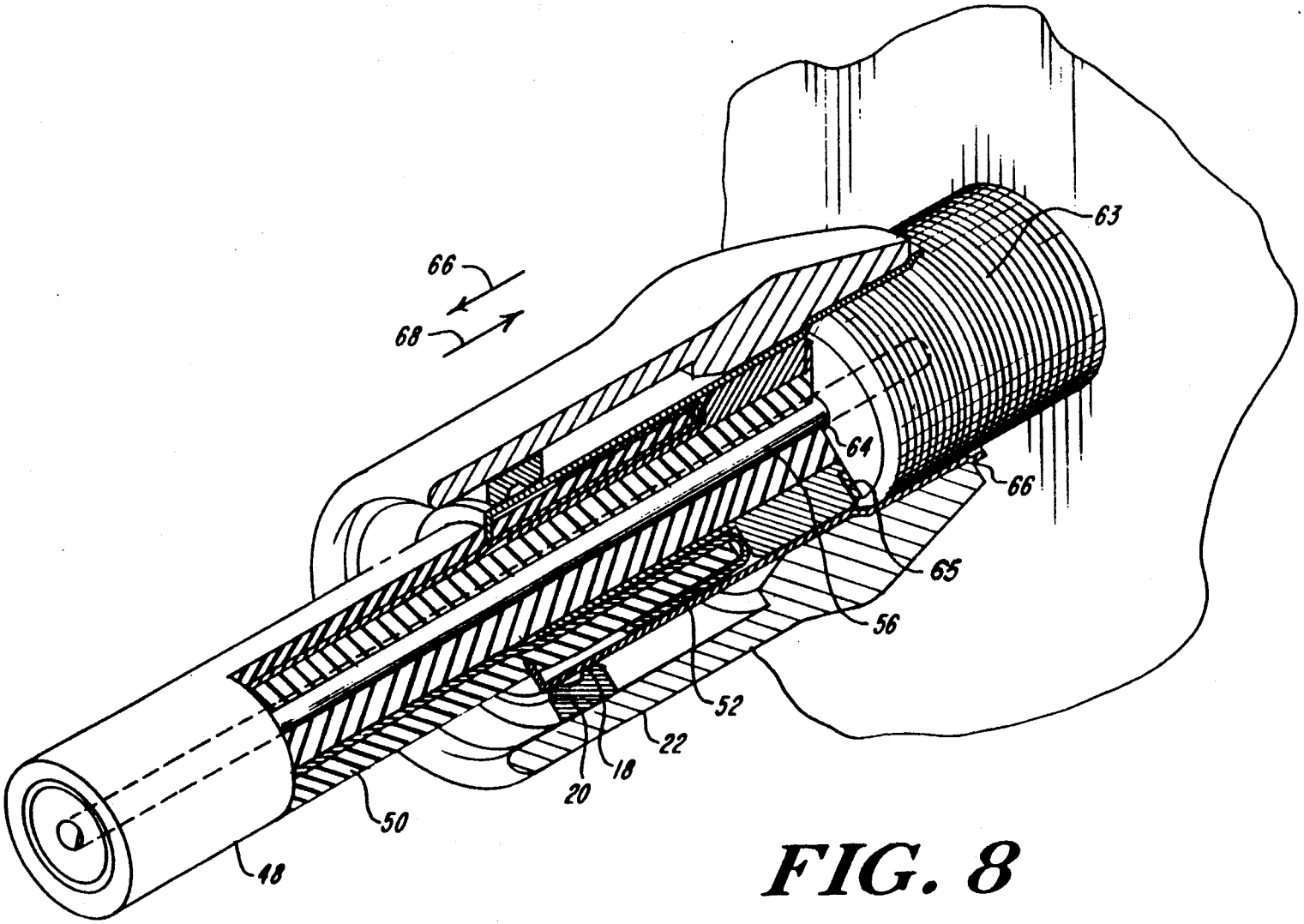
FIG. 8 is a sectioned view of the connector of FIG. 1 attached to an interface port.

With the coaxial cable locked in place, referring now to FIG. 7B, the slotted collar end 16 of the connector body 14 may protrude from the interface end 26 of the housing sleeve 22. The slotted collar end is suited for slipping onto the outer sheath 63 of the coaxial cable interface port illustrated in FIG. 6B. The slotted collar end is slipped onto the interface port such that the exposed center conductor 56 of the installed coaxial cable is mechanically and electrically engaged by the complementary conductive receptacle 64 of the interface. With adequate electrical engagement between the outer sheath 63 of the interface port and the collar end of the connector, the housing sleeve 22 may be manually actuated in a second direction 68, to cause the interior of the housing sleeve to co-act with stepped portion 45 of the slotted collar end 16 of the connector body 14. The slots 44 in the collar end permit the collar end 16 to compress and frictionally engage the outer sheath 63 so that the connector is locked onto the interface port as illustrated in FIG. 8. To remove the manually installable coaxial cable connector from the interface, the housing sleeve 22 is merely manually reactuated in the first direction 66 to decrease the frictional engagement so that the connector can be slipped off of the interface.

While the illustrative example of a manually installable coaxial cable connector is described hereinbefore as having a plastic housing and locking ring fabricated from Celcon UV90, a center post fabricated from tin plated brass and a connector body made of nickel/silver alloy, other materials can be employed in the fabrication of a coaxial cable connector according to the invention.

Although the connector as described hereinbefore has a stepped collar co-acting with the interior of the housing sleeve, it can be appreciated that one or the other surface could co-act with a gradually inclined or smooth surface and still effect frictional engagement of the connector collar on an interface port.

While the connector as described may have the locking ring actuation limited by an integral stop, other stop means can be incorporated.

Although the illustrative embodiment herein is described as having a center post with an annular portion conformed to and engaged with a somewhat cylindrical connector body intermediate portion, it can be appreciated that various geometries can be used, such as a rectangular or square portion instead of annular, for engagement with a conforming interior portion.

Although the invention has been shown and described with respect to an illustrative embodiment thereof, it should be appreciated by those skilled in the art that various changes, omissions and additions in the form and detail thereof may be made without departing from the spirit and scope of the invention as delineated in the claims.

What is claimed is:

1. A cable connector for mating a cable to an interface port, wherein said cable includes a conductor, an interior insulation, a shield and an insulating jacket and said interface port includes a conductive receptacle and an outer sheath, said cable connector comprising:

a housing having a cable insert end and an interface end;

a connector body dimensioned to fit substantially within said housing, said connector body comprising a collar end, a resilient fingered end and an intermediate portion therebetween;

a center post having a conforming portion with an outer dimension sized for conforming engagement with said intermediate portion of said connector body and a tubular portion dimensioned to receive said interior insulation and to electrically engage said shield of said cable; and a locking member having an inner dimension to snugly, slidably engage said resilient fingered end of said connector body and an outer dimension slidably engagable with a portion of said housing, wherein said cable is manually installable within said connector by actuating said housing in a first direction such that said resilient fingered end engages said insulating jacket and said connector is manually installable on said interface port by actuating said housing in a second direction to facilitate frictional engagement of said collar end of said connector body and said outer sheath of said interface port.

2. The cable connector of claim 1 wherein said housing has an interior surface proximate to said interface end and engagable with said collar end of said connector body to facilitate frictional engagement between said slotted collar end and said outer sheath of said interface port.

3. The cable connector of claim 1 wherein said collar end of said connector body includes a stepped exterior surface engagable with an interior surface of said housing to facilitate frictional engagement between said collar end and said outer sheath of said interface port.

4. The cable connector of claim I wherein said portion of said housing engagable with said outer dimension of said locking ring comprises an interior surface having a shoulder therein.

5. The cable connector of claim 1 further comprising an end cap engagable with said interface end of said housing.

6. The cable connector of claim 1 wherein said collar end has a plurality of slots.

7. The cable connector of claim 1 wherein said resilient fingered end has a plurality of axial serrations disposed thereon.

8. The cable connector of claim 1 wherein said connector is manually installable on a coaxial cable having a braided shield.

9. The cable connector of claim 1 wherein said locking member is a ring having an inner diameter dimensioned to slidably engage said resilient fingered end of said connector body.

10. The cable connector of claim 1 wherein said resilient fingered end comprises a plurality of axial serrations that pierce said insulating jacket upon said connector being manually installed on said cable.

11. The cable connector of claim 1 wherein said center post has a depression disposed on said conforming portion to facilitate frictional engagement with a connector body crimped thereon.

12. The cable connector of claim 1 wherein said center post has a flange disposed proximate to said conforming portion, said flange abuttingly engaging said interior insulation of said cable upon said cable being fully installed within said connector.

13. The cable connector of claim 1 wherein said conforming portion is substantially annular and conforms to a substantially cylindrical interior portion of said connector body.

14. The cable connector of claim 1 further comprising a stop for limiting actuation of said locking ring upon said housing being actuated in said first direction.

15. The cable connector of claim 14 wherein said stop is integral with said connector body.

16. The cable connector of claim 15 wherein said stop has at least one point disposed thereon.

17. The cable connector of claim 1 wherein said housing further includes an exterior surface having means for facilitating manual gripping of said housing.

18. The cable connector of claim 17 wherein said means for facilitating manual gripping comprises knurling on said exterior surface.

19. The cable connector of claim 17 wherein said means for facilitating manual gripping comprises at least one depression having a jagged surface.

* * * * *

UNITED STATES PATENT AND TRADEMARK OFFICE

CERTIFICATE OF CORRECTION

PATENT NO. : 5,181,861

DATED : January 26, 1993

INVENTOR(S) : Joseph C. Gaver, Jr., et al.

It is certified that error appears in the above-indentified patent and that said Letters Patent is hereby corrected as shown below:

Column 4, line 15, "center post 1" should read --center post 12--.

Column 5, line 43, "first 12 direction" should read --first direction--.

Signed and Sealed this

Twenty-sixth Day of April, 1994

*Attest:*

*Attesting Officer*

BRUCE LEHMAN

*Commissioner of Patents and Trademarks*